US007137259B2

(12) United States Patent
O'Baid et al.

(10) Patent No.: US 7,137,259 B2
(45) Date of Patent: Nov. 21, 2006

(54) CRYOCOOLER HOUSING ASSEMBLY APPARATUS AND METHOD

(75) Inventors: Amr Hassan O'Baid, Goleta, CA (US); Mark Hanes, Goleta, CA (US)

(73) Assignee: Superconductor Technologies Inc., Santa Barbara, CA (US)

( * ) Notice: Subject to any disclaimer, the term of this patent is extended or adjusted under 35 U.S.C. 154(b) by 0 days.

(21) Appl. No.: 10/729,719

(22) Filed: Dec. 5, 2003

(65) Prior Publication Data

US 2005/0120721 A1 Jun. 9, 2005

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | |
|---|---|---|---|---|
| 3,148,512 | A * | 9/1964 | Hoffman et al. | 62/6 |
| 3,717,004 | A * | 2/1973 | O'Neil | 62/6 |
| 3,802,211 | A * | 4/1974 | Bamberg et al. | 62/6 |
| 4,231,418 | A * | 11/1980 | Lagodmos | 165/4 |
| 4,602,174 | A | 7/1986 | Redlich | |
| 4,711,650 | A * | 12/1987 | Faria et al. | 62/6 |
| 5,020,218 | A * | 6/1991 | Strasser | 29/890.035 |
| 5,525,845 | A | 6/1996 | Beale et al. | |
| 5,653,112 | A | 8/1997 | Gresko | |
| 6,070,414 | A | 6/2000 | Ross et al. | |
| 6,141,971 | A | 11/2000 | Hanes | |
| 6,327,862 | B1 * | 12/2001 | Hanes | 62/6 |
| 6,427,450 | B1 | 8/2002 | Hanes | |
| 6,446,336 | B1 | 9/2002 | Unger | |
| 6,446,444 | B1 | 9/2002 | Chase et al. | |
| 6,483,207 | B1 | 11/2002 | Redlich | |
| 6,857,267 | B1 | 2/2005 | Yamagiri et al. | |

FOREIGN PATENT DOCUMENTS

| | | |
|---|---|---|
| DE | 38 36 959 A1 | 5/1990 |
| JP | 2001-349247 | 12/2001 |
| JP | 2003-130480 | 5/2003 |
| WO | WO 03/102375 A1 | 12/2003 |

OTHER PUBLICATIONS

Benschop, T. et al., "Development of a 6W high reliability cryogenic cooler at Thales Cryogenics," 9 pages (2002).
Cheuk, C. et al., "Producibility Of Cryocooler Compressors," *Presented to the 12th International Cryocooler Conference,* Copyright Kluwer Academic/Plenum Press, New York, pp. 1-8 (Jun. 2002).

(Continued)

*Primary Examiner*—William C. Doerrler
(74) *Attorney, Agent, or Firm*—Merchant & Gould P.C.

(57) ABSTRACT

A cryocooler cold end assembly is disclosed. The assembly includes a unitary external, outer housing. By constructing the housing from a single unitary metal shell, part count is reduced from prior art assemblies. Additionally, all brazing requirements previously necessary to secure and seal the components are eliminated. Further, due to one or more machining steps subsequent to manufacturing/forming the external sealed housing, the tolerances are improved. This allows for shrink to fit assembly of several components and also results in improved straight-line accuracy between the piston bore and the displacer cylinder. Due to this latter improvement, the need for a displacer liner is eliminated.

22 Claims, 18 Drawing Sheets

OTHER PUBLICATIONS

Hanes, M., "Performance and Reliability Improvements in a Low Cost Stirling Cycle Cryocooler," *11th International Cryocooler Conference,* 9 pages (Jun. 22, 2000).

Hanes, M. et al., "Use of Variable Reluctance Linear Motor for a Low Cost Stirling Cycle Cryocooler," *10th International Cryocooler Conference,* 8 pages (May 28, 1998).

Hanes, M. et al., "Performance & Reliability Data for Production Free Piston Stirling Cryocooler," *12th International Cryocooler Conference,* pp. 1-5 (Jun. 20, 2002).

Ikuta, Y. et al., "Development of a Long-Life Stirling Cryocooler," *11th International Cryocooler Conference,* 6 pages (Jun. 2000).

Loung, V., et al., "Path to Low Cost and High Reliability Stirling Coolers," *9th International Cryocooler Conference,* pp. 97-108 (1997).

Stolfi, F. et al., "Parametric Testing of a Linearly Driven Stirling Cryogenic Refrigerator," *Proceedings of the Third Cryocooler Conference*, NBS Special Publication 698, pp. 80-98 (Sep. 17-18, 1984).

* cited by examiner

CRYOCOOLER HOUSING ASSEMBLY APPARATUS AND METHOD

FIELD OF THE INVENTION

The present invention relates generally to cryocoolers, more particularly to a unitary cryocooler cold-end assembly housing, and still more particularly to a unitary cold-end assembly housing which eliminates/minimizes brazing and provides design flexibility to locate out-gassing components either internally or externally.

BACKGROUND

The market for superconductor products has been growing, especially in light of a significant expanding commercial application. More specifically, high temperature superconductor ("HTS") devices and systems have been successfully employed in cellular communication base station filters. Such filters are designed to reduce signal interference and increase base station sensitivity.

To operate in their intended manner, superconductor devices must generally be cooled to extremely low temperatures. For current HTS devices, the devices must be cooled to about seventy-seven (77) K or lower. These cryogenic temperatures can be reached using a cryocooler or by submersing the device to be cooled in a fluid which boils at a low temperature. Liquids that are commonly used to achieve cryogenic temperature are Nitrogen, which boils at seventy-seven (77) K and Helium, which boils at four (4) K. Cryocoolers generally operate by either controlled evaporation of volatile liquids (using the heat of vaporization as the means to cool), by controlled expansion of gasses confined initially at high pressure (such as 150 to 200 atmospheres), or by acting as a heat-pump by alternatively expanding a gas near the area to be cooled (absorbing heat by the so-called heat of expansion), then compressing the gas at another location (removing the heat by the heat of compression) in a closed-cycle. One of the highest efficiency cryocoolers is a closed-cycle cryocooler based upon the Stirling cycle.

Stirling cycle refrigeration units (or Stirling cycle cryocoolers) typically comprise a displacer assembly and a compressor assembly, wherein the two assemblies are in fluid communication with one another. The assemblies are generally driven by a prime mover. The prime mover may be implemented with an electromagnetic linear or rotary motor.

Conventional displacer assemblies generally have a "cold" end and a "hot" end. The hot end is in fluid communication with the compressor assembly. Displacer assemblies generally include a displacer having a regenerator mounted therein for displacing a fluid, such as Helium, from one end (i.e., the cold end) of the displacer assembly to the other end (i.e., the hot end) of the displacer assembly. The compressor assembly functions to apply additional pressure to the fluid when the fluid is located substantially within the hot end of the displacer assembly, and to relieve pressure from the fluid, when the fluid is located substantially within the cold end of the displacer assembly. In this fashion, the cold end of the displacer assembly may be maintained, for example, at seventy seven (77) K, while the hot end of the displacer assembly is maintained, for example, at fifteen (15) degrees above ambient temperature (e.g., at about 313 K).

One of the drawbacks of current cryocoolers is the use of a large number of components. In particular, there are a number of components that make up the external housing. Since the device operates by compressing and expanding a fluid, the cryocooler must be completely sealed. In practice, the various components are brazed together in order to accomplish this requirement (e.g., to seal the cryocooler from ambient atmosphere). However, brazing is very labor intensive. Further, the brazing operation often introduces unwanted variances in the linearity of the assemblies. This increases the required tolerances in the device and has lead to including additional component parts to accommodate the larger required tolerances and non-linearities.

Another drawback of current cryocoolers is the inclusion of various components into the interior of the cryocooler. Many of these components exhibit outgassing (e.g., the diffusion of gas from the component into the internal sealed environment of the cryocooler). Examples of components that may outgas include the motor coil, the outer lamination, and epoxies used to bond various components together. By introducing unwanted gasses into the internal sealed environment, gassing often lowers the efficiency of the cryocooler.

Accordingly, there is a need in the art to develop a cryocooler with a minimum of components forming the external sealed housing. By doing so, the concentricity alignment between components may be improved. Further, there is a need for design flexibility of the external sealed housing related to utilizing both inner and outer motors. The present invention directly addresses and overcomes the shortcomings of the prior art.

SUMMARY OF THE INVENTION

The present invention provides for an apparatus and method for improving the tolerances and efficiency of a cryocooler cold end assembly. More specifically, the part count of the assembly is reduced and the labor intensive brazing and adhering steps are eliminated. This results in an improvement in both the manufacturing time and cost of the cryocooler. The part count is reduced in two ways. First, the components forming the external sealed housing of the cryocooler are minimized. Second, the cylindrical components (e.g., displacer, cylinder bore, and piston bore) are trued to each other by machining after installation. By truing the components, some parts can be eliminated, such as the prior art displacer cylinder bore (displacer liner).

As discussed above, in the past brazing was often employed as the construction method for connecting and sealing the various components. However, the present invention preferably eliminates brazing. Further, by machining the final critical diameters of the housing, the concentricity alignment is improved. In some instances, bushings and other friction reducing components may be eliminated entirely. Other components required epoxy bonding. By eliminating the need for this type of component assembly, another source of outgassing is removed. In some instances such as an outer design motor, outgassing components may be moved to the exterior of the external sealed housing. In this instance less contamination of the internal fluid/gas environment occurs. It will be appreciated that when the desired internal fluid/gas environment is maintained at closer to the specified levels, then the efficiency of the cryocooler is improved.

In a preferred embodiment constructed according to the principles of the present invention, the external sealed housing is constructed from a single unitary metal shell. By doing so, up to ten components of prior cryocooler cold-end assemblies are consolidated into a single part. Additionally, all brazing requirements previously necessary to secure and seal the components are eliminated. Further, due to one or more machining steps subsequent to manufacturing/forming the external sealed housing, the tolerances are improved. This allows for shrink to fit assembly of several components and also results in improved straight-line accuracy between the piston bore and the displacer cylinder. Due to this latter improvement, the need for a displacer liner is eliminated.

A cold-end assembly constructed in accordance with the principles of the present invention includes a compressor and a linear motor assembly, a heat exchanger unit, and a displacer assembly. These components are assembled and located within the external sealed housing. A vacuum flange, an external heat rejector, an external lamination assembly and a coil for the motor are arranged and configured on the outside of the external sealed housing in the case of an outer motor design embodiment. In the case of an inner motor design embodiment, only a vacuum flange and a heat rejector are arranged and configured on the outside of the external sealed housing. In either embodiment, by machining certain portions of the external sealed housing and thereby improving and controlling tolerances, several of these assemblies can be matingly seated on or within the external sealed housing in a shrink to fit process. This process can include heating a part/assembly so that it expands and then press fitting it into place. By correctly sizing the various parts and assembly, when the part/assembly cools it is securely seated on or within the external sealed housing.

A feature of the present invention is the use of a non-brazed internal heat exchanger. The preferred heat exchanger is a readily machined or extruded aluminum alloy. However, the heat exchanger may be constructed of any material exhibiting good conduction properties. The prior art use of brazed fins introduced time intensive assembly processes and necessitated increased tolerances. The machined or extruded heat exchanger provides improved yield, thermal management, and a more consistent part.

Other features of the present invention include the elimination of electrical feed-throughs in the external sealed housing for the outer motor embodiment, the optional utilization of a flexure bearing, a gas bearing or other bearing designs, and the optional utilization of a moving coil motor, a moving magnet motor, or other motor designs.

In the case of the optional gas bearings, such bearings preferably use the working fluid to reduce and ideally eliminate friction between the piston and the cylinder comprising the compressor. To implement the gas bearings, pressurized gas may be passed through a check valve into a sealed interior of the piston. This provides a source of pressurized gas for the gas bearing that does not fluctuate significantly with the pressure of any gas that resides in the compression chamber of the compressor assembly. Other cryocooler designs utilize lubricants that influence the working fluid purity or rubbing surfaces that influence the operating life capacity.

Therefore, according to one aspect of the invention, there is provided, an external housing for a cold-end assembly of a cryocooler, of the type including a heat exchanger, a displacer cylinder assembly and a displacer cylinder primary mover, the external housing comprising: a substantially unitary housing arranged and configured to house the heat exchanger, the displacer cylinder assembly and at least a portion of the displacer cylinder primary mover. Another aspect of the invention includes the preceding housing and further comprising a first section arranged and configured to act as a cold finger and to substantially house the displacer cylinder assembly; a second section arranged and configured to substantially house a heat exchanger; and a third section arranged and configured to substantially house at least a portion of the displacer cylinder primary mover.

According to another aspect there is provided a housing for a cold-end assembly of a cryocooler, of the type that includes a heat exchanger, a displacer cylinder assembly and a displacer cylinder primary mover, comprising: a first section arranged and configured to act as a cold finger and to substantially house the displacer cylinder assembly; a second section arranged and configured to substantially house a heat exchanger; and a third section arranged and configured to substantially house at least a portion of the displacer cylinder primary mover; and wherein at least two of the first section, second section and third section are seamlessly connected to one another.

According to yet another aspect of the invention, there is provided, a cold end assembly, of the type used to compress a fluid at a hot end and deliver a cooled fluid to a cold end, comprising: a primary mover; a displacer cylinder operatively connected to the primary mover for compressing; a heat exchanger; and a substantially seamless and/or unitary housing arranged and configured to support and substantially enclose the displacer cylinder and the heat exchanger, and to support and enclose at least a portion of the primary mover.

Yet another aspect of the invention includes a method of fabricating a cold end assembly for a cryocooler, comprising: drawing a unitary housing for the cold end assembly; machining at least one selected internal diameter of the housing; installing a piston bore assembly proximate to at least one of the machined internal diameters; machining at least one selected external diameter of the housing; and installing a vacuum flange proximate to at least one of the selected external diameters.

While the invention will be described with respect to the preferred embodiment configurations and with respect to particular devices used therein, it will be understood that the invention is not to be construed as limited in any manner by either such configuration or components described herein. Also, while the particular shape and unitary nature of the sealed external housing are described herein, it will be understood that such particular shape and unitary structure is not to be construed in a limiting manner. Instead, the principles of this invention extend to minimizing the number of components to construct the sealed external housing so as to eliminate brazing and/or improve tolerances. Further, while the preferred embodiment(s) of the invention will be generally described in relation to use of the cryocooler in a cellular base station environment, it will be understood that the scope of the invention is not to be so limited. These and other variations of the invention will become apparent to those skilled in the art upon a more detailed description of the invention.

The advantages and features, which characterize the invention, are pointed out with particularity in the claims annexed hereto and forming a part hereof. For a better understanding of the invention, however, reference should be had to the drawings which form a part hereof and to the accompanying descriptive matter, in which there is illustrated and described a preferred embodiment of the invention.

BRIEF DESCRIPTION OF THE DRAWINGS

Referring to the drawings, wherein like numerals represent like parts throughout the several views.

DETAILED DESCRIPTION

A cryocooler including a cold-end assembly constructed in accordance with the principles of the present invention may be employed in a variety of environments and with a variety of other components. However, the principles apply to a method and apparatus for improving the tolerances and efficiency of a cryocooler cold end assembly. The improvements are realized by minimizing the components forming the external sealed housing of the cryocooler and by optionally locating out-gassing components to the exterior of the external sealed housing.

Figure 1:
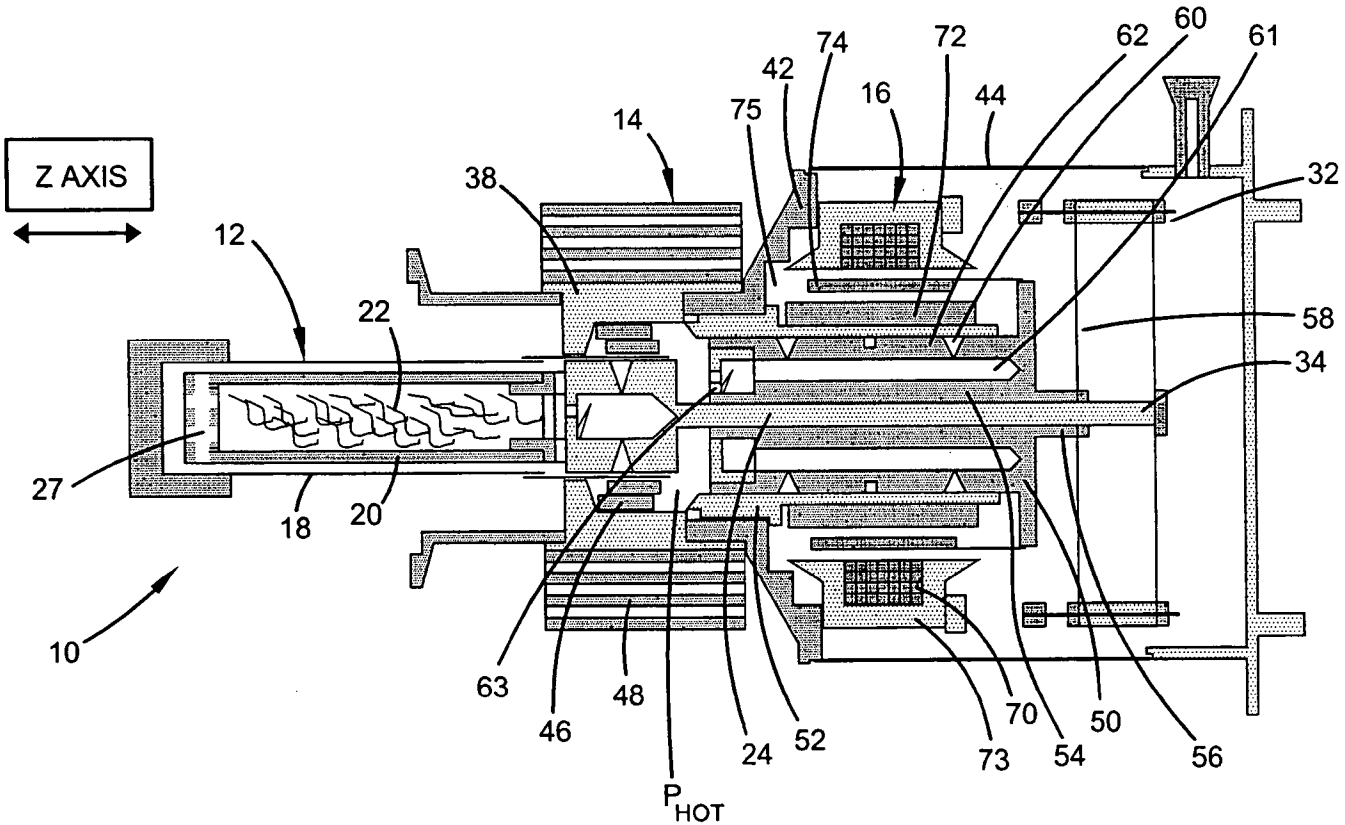
FIG. 1 PRIOR ART
FIG. 1 is a cross sectional illustration of a prior art cold end assembly.

A discussion of the preferred embodiment cold-end assembly will be deferred pending a discussion of a prior art cold-end assembly shown in FIG. 1. A representative prior art Stirling cycle cryocooler 10 is illustrated. The cryocooler 10 is described in more detail in U.S. Pat. No. 6,327,862, titled STIRLING CYCLE CRYOCOOLER WITH OPTIMIZED COLD END DESIGN, and assigned to the assignee of the present invention. Such patent is incorporated herein and made a part hereof. Accordingly, not all of the components or the operation of the cryocooler will be discussed herein. The cryocooler 10 of FIG. 1 generally includes a displacer unit 12, a heat exchanger unit 14, and a compressor and linear motor assembly 16.

The displacer unit 12 functions in a conventional manner and preferably includes a displacer housing 18, a displacer cylinder assembly 20 having a regenerator unit 22 mounted therein, and a displacer rod assembly 24. The displacer cylinder assembly 20 is slideably mounted in the axial direction (i.e., the Z axis) within the displacer housing 18 and rests against the displacer liner that is affixed to the inner surface of the displacer housing 18. A displacer end cap 27 is provided within a distal end of the displacer cylinder assembly 20. The displacer rod assembly 24 is connected at one end to the displacer cylinder assembly 20 and coupled at the other end 34 to a displacer flexure spring assembly 32. Thus, under appropriate conditions, it is possible for the displacer cylinder assembly 20 to oscillate within the displacer housing 18.

The heat exchanger unit 14 is located between the displacer unit 12 and the compressor and linear motor assembly 16. The heat exchanger unit includes a heat exchanger block 38, a flow diverter or equivalent structure, and a heat exchanger mounting flange 42. The heat exchanger mounting flange 42 is coupled to a distal end of a pressure housing 44 of the compressor and linear motor assembly 16. The heat exchanger block 38 includes a plurality of internal heat exchanger fins 46 and a plurality of external heat rejector fins 48. Thus, the heat exchanger unit 14 is designed to facilitate heat dissipation from a gas, such as Helium, that is compressed in the region located at the juncture between the displacer unit 12 and the compressor and linear motor assembly 16 (this region, $P_{HOT}$, may also be referred to as the compression chamber of the compressor and linear motor assembly 16). The heat exchanger block 38, internal heat exchanger fins 46 and external heat rejector fins 48 are generally made from high purity copper.

The compressor and linear motor assembly 16 include a pressure housing 44 that has a piston assembly 50 mounted therein. The piston assembly 50 includes a cylinder 52, a piston 54, a piston assembly mounting bracket 56 and a spring assembly 58. The piston assembly mounting bracket 56 provides a coupling between the piston 54 and the spring assembly 58, and the piston 54 is adapted for reciprocating motion within the cylinder 52. A plurality of gas bearings 60 is provided within the exterior wall 62 of the piston 54, and the gas bearings 60 receive gas, e.g., Helium, from a sealed cavity 61 that is provided within the piston 54. A check valve 63 provides a unidirectional fluid communication conduit between the sealed cavity 61 and the compression chamber of the cylinder (e.g., the area designated $P_{HOT}$) when the pressure of the gas within that region exceeds the pressure within the cavity 61 (i.e., exceeds the piston reservoir pressure).

The piston 54 preferably has mounted thereon a plurality of magnets 74. Internal laminations 72 are secured to the outside of the cylinder 52. External laminations 73 are secured within the pressure housing 44 and are located outward of the magnets 74. The external laminations 73 are preferably secured to a mounting flange 42. The internal and external laminations 72, 73 are preferably made of an iron-containing material. A motor coil 70 preferably lies within the external laminations 73 and surrounds the piston 54. The motor coil 70 is preferably located outward of the magnets 74 and within recesses formed within the external laminations 73. Thus, it will be appreciated that, as the piston 54 moves within the cylinder 52, the magnets 74 move within a gap 75.

Figure 2A:
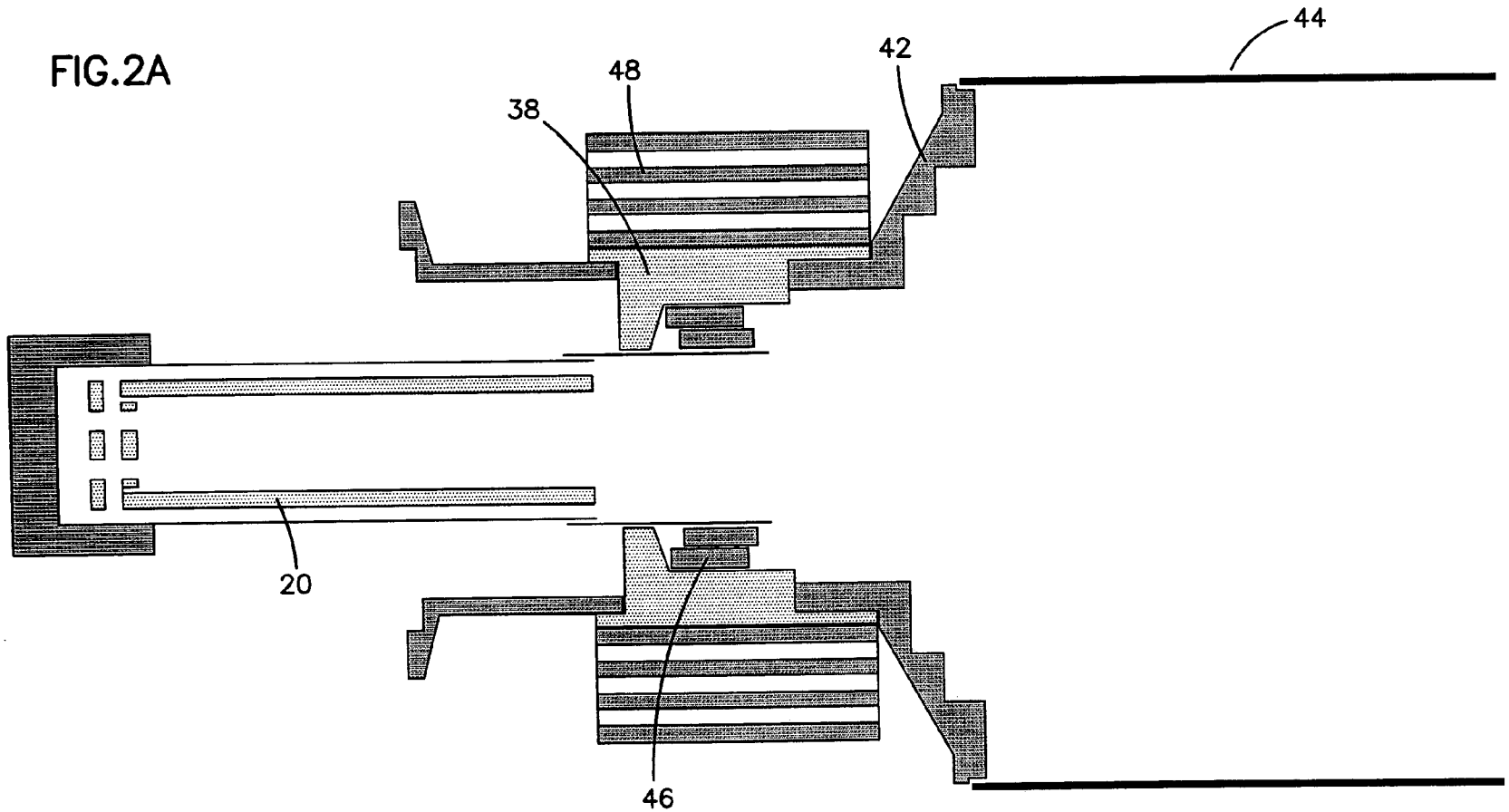
FIG.2A PRIOR ART
FIG. 2*a* is a cross sectional illustration of the external components of the cold end assembly of FIG. 1.

It will be appreciated from the foregoing that a number of components make up the external sealed housing. FIG. 2*a* illustrates the various components making up the external sealed housing in more detail. Brazing is utilized to bond and seal a number of the various components to one another. Still further, there are a number of components that are assembled using various epoxy bonds.

Figure 3:
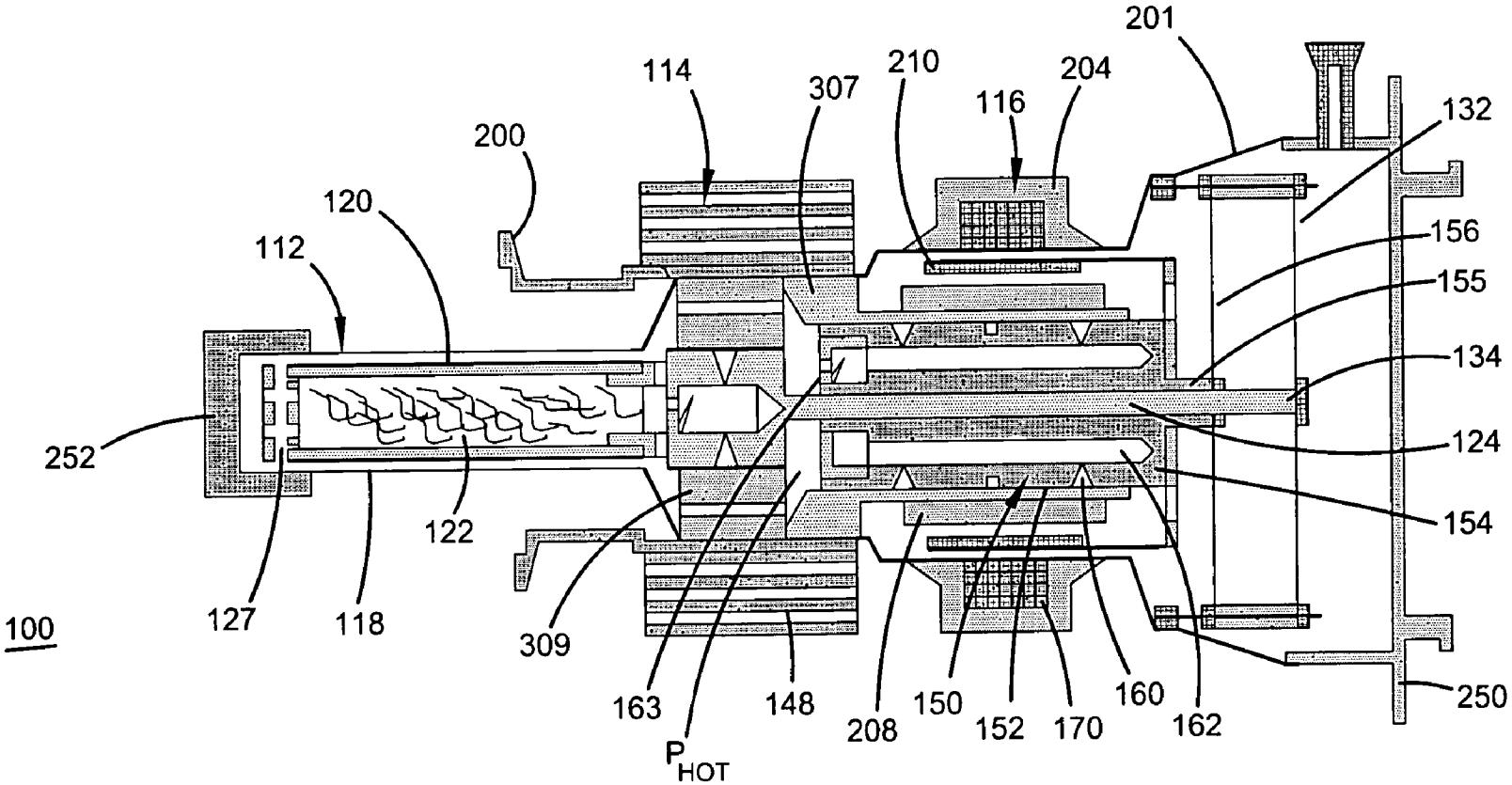
FIG. 3 is a cross-sectional illustration of a cold end assembly constructed in accordance with the principles of the present invention, wherein the motor is located partially external to the sealed external chamber.

Turning now to FIG. 3, a cross section view of a cold-end cryocooler assembly constructed in accordance with the principles of the present invention is illustrated. The cryocooler is designated at 100 and generally includes an external sealed housing 201 that provides structural support for the various components, parts and assemblies of the cold-end assembly. The major assemblies of the cold-end assembly include a displacer unit 112, a heat exchanger unit 114, and a compressor and linear motor assembly 116. The linear motor assembly acts as the prime mover for the compressor. Each of the assemblies will be discussed in greater detail below.

Figure 4:
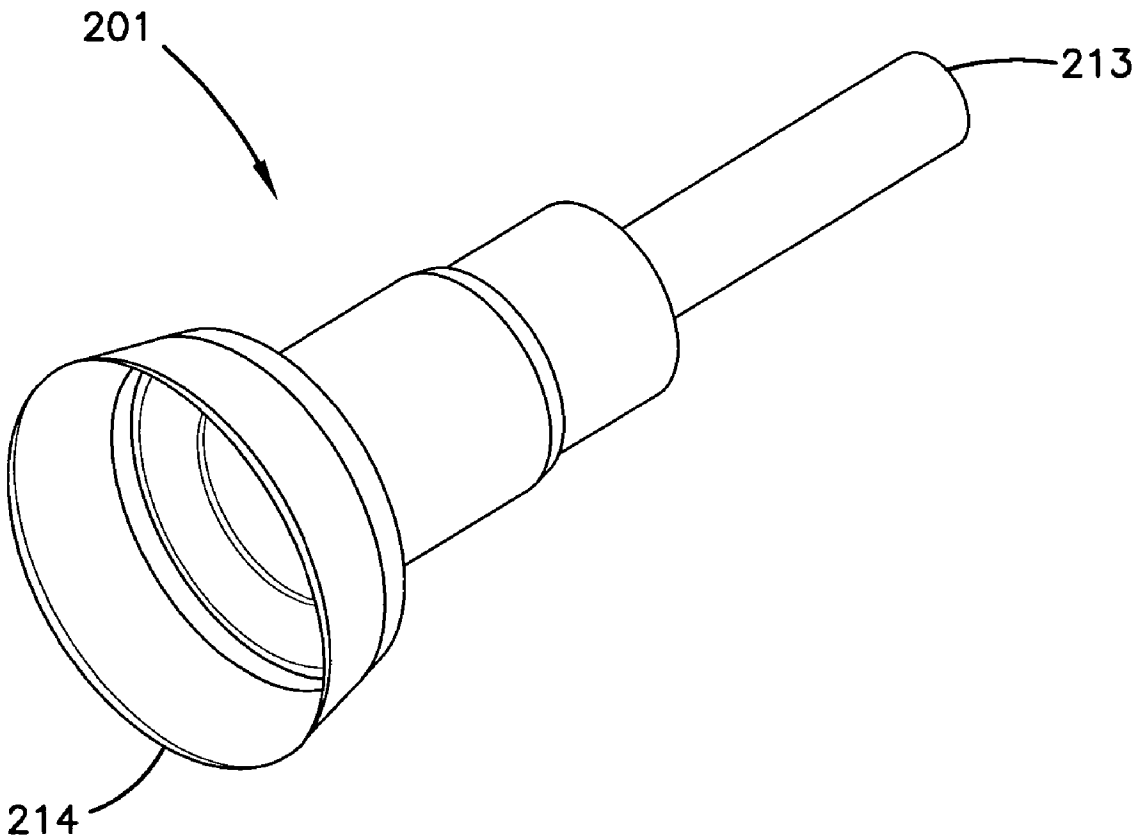
FIG. 4 is a perspective view of a sealed external chamber of FIG. 3.
Figure 5A:
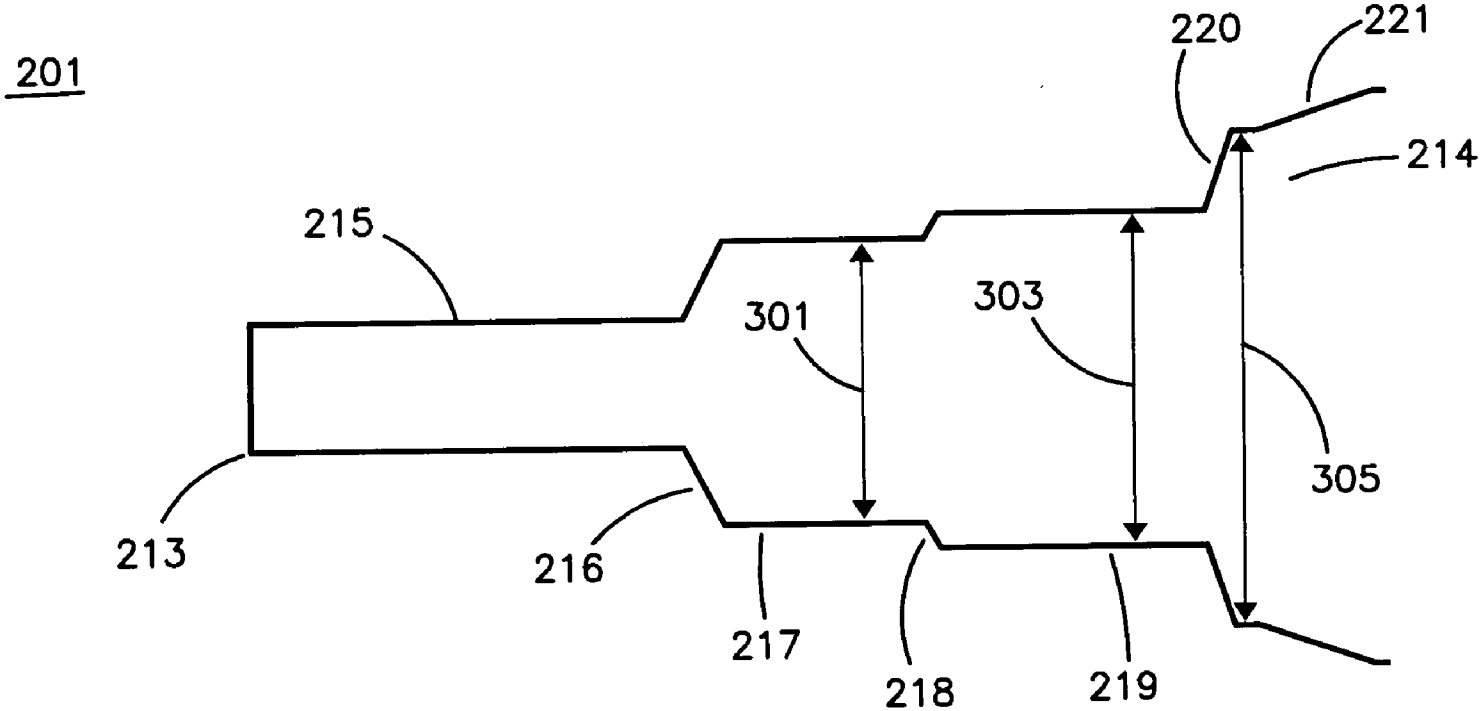
FIGS. 5*a*–5*f* are a series of cross-section illustrations for machining and assembling of a cold end assembly constructed in accordance with the principles of the present invention.
Figure 5B:
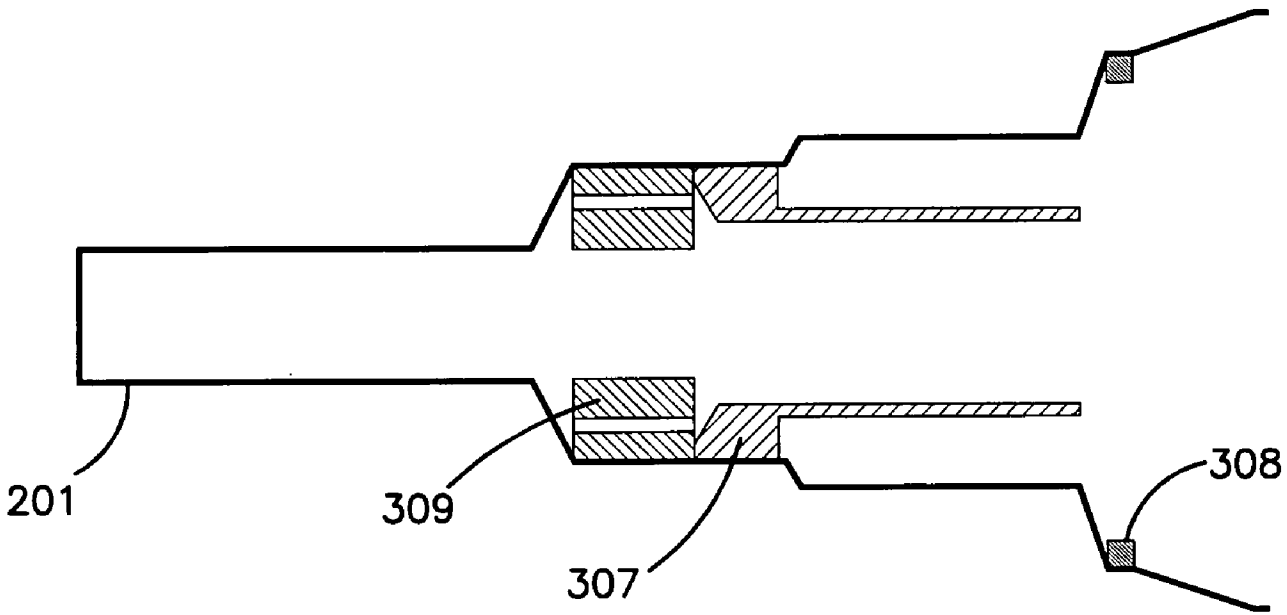
Figure 5C:
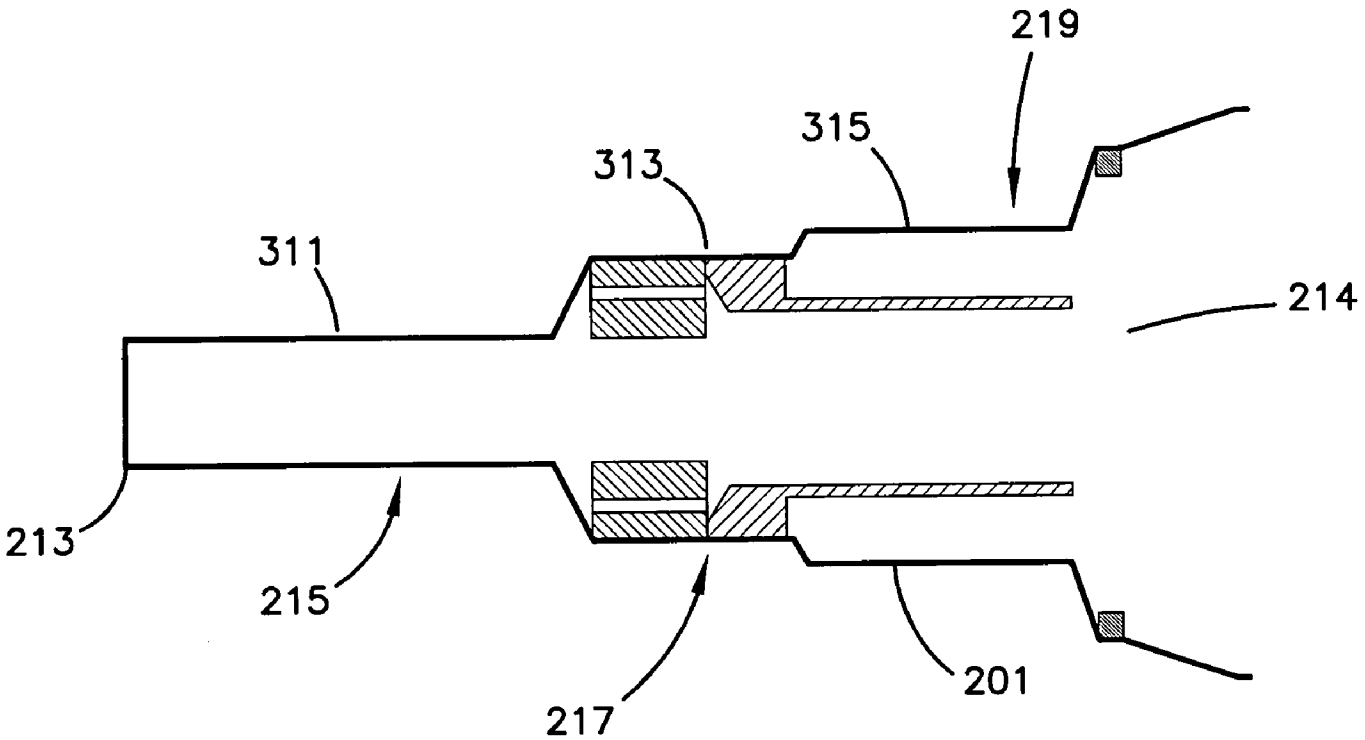
Figure 5D:
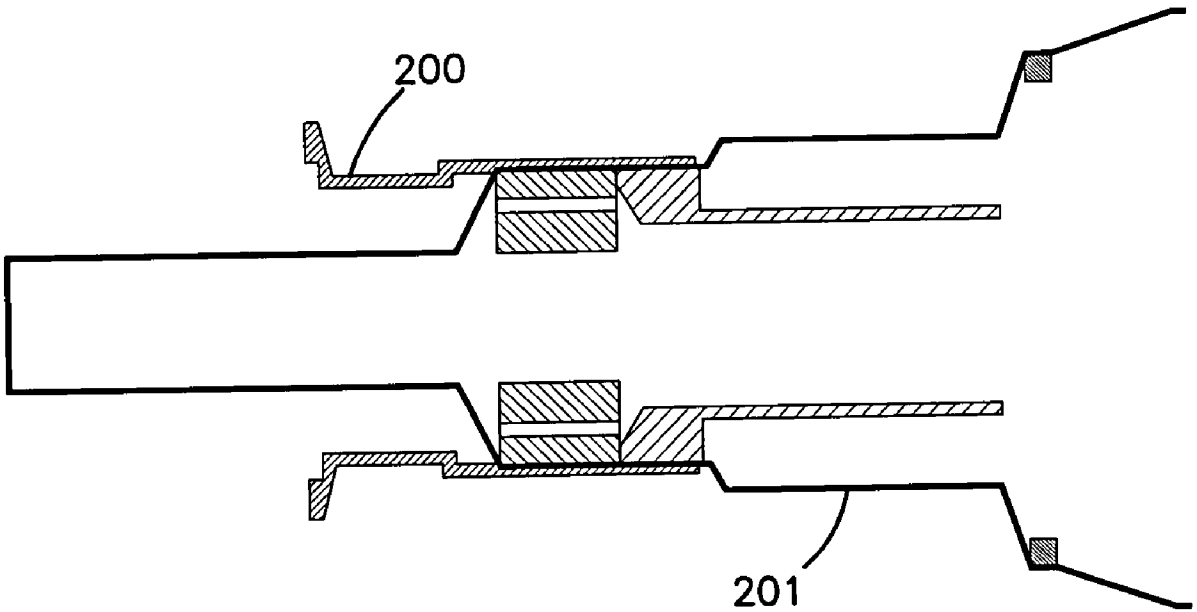
Figure 5E:
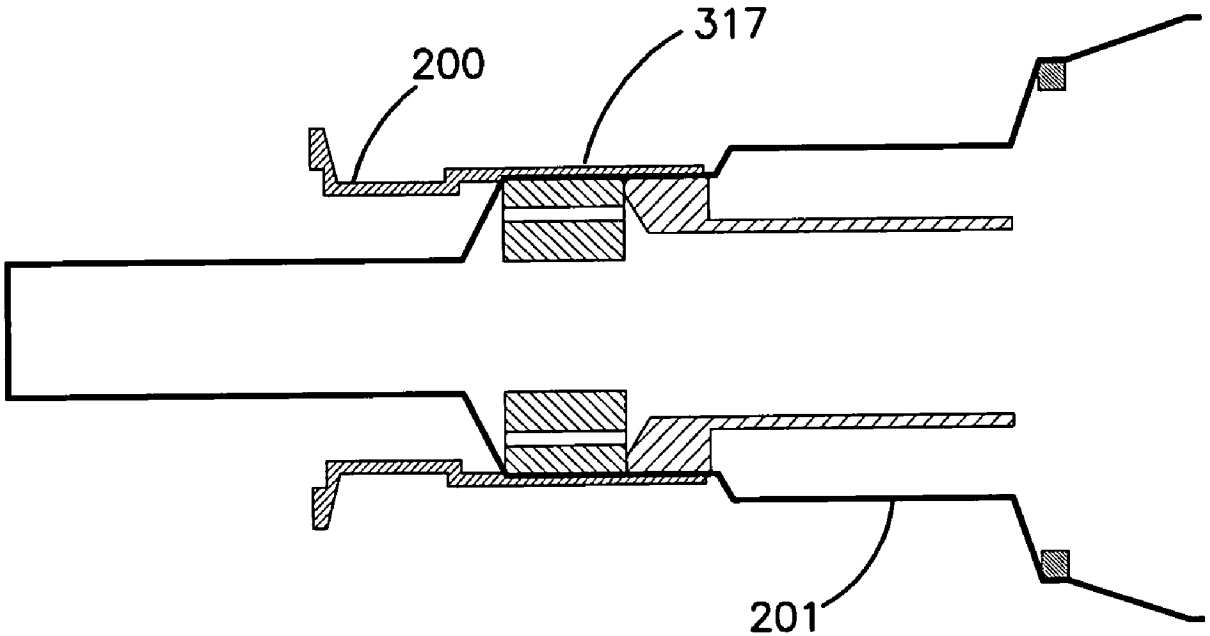
Figure 5F:
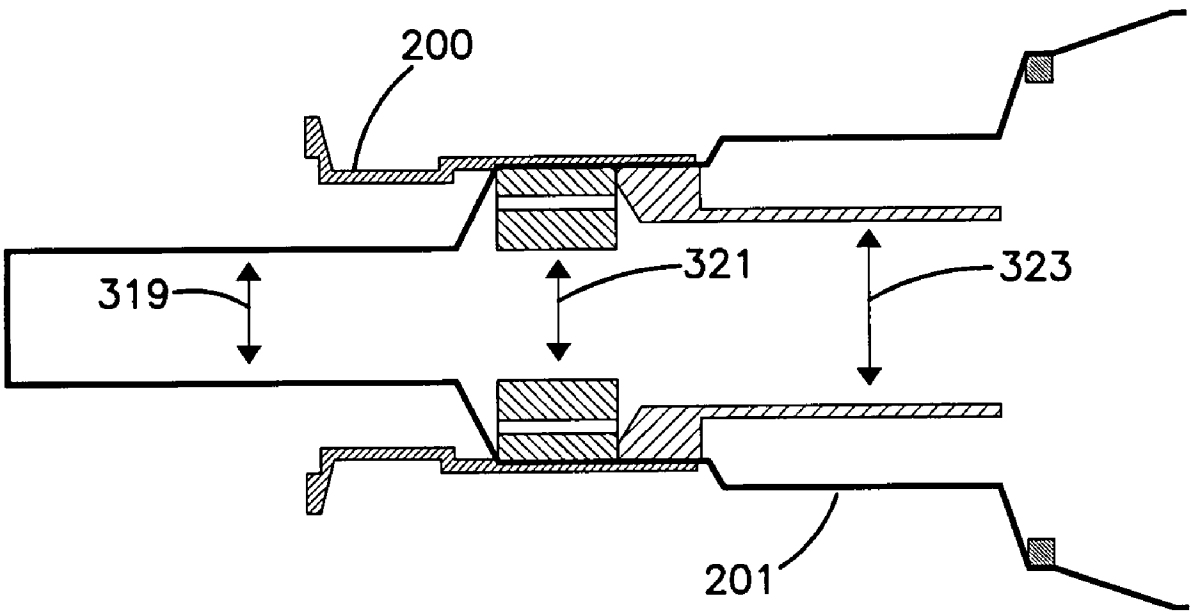

FIG. 4 illustrates the external sealed housing 201 in a perspective view. FIG. 5*a* illustrates the external sealed housing 201 in cross section. From FIGS. 4 and 5*a*, it will be appreciated that the housing 201 is a unitary construction of "stainless steel 304." Such material is a widely used stainless steel, and generally has a content of about 18 and 8 percent chromium and nickel content, respectively. The material provides a good combination of strength and corrosion resistance, as well as providing good fabrication characteristics. The material is resistant to a wide range of environments between moderately reducing and slightly oxidizing. In the present case, it forms the material for housing 201 that seals the Helium internal atmosphere. The material also offers appropriate structural support for the various subassemblies. In the preferred embodiment, the material is drawn from a starting disk of sheet metal approximately eight and three-quarters inch (8 and ¾") diameter. After being drawn, in a preferred embodiment, the final largest outside diameter is approximately 3.442" diameter and the housing 201 has an approximate height of 8.546".

Other materials exhibiting the necessary properties for housing 201 include Titanium, Inconel or Cobalt. Other materials might also be utilized. The desirable characteristics of the materials include structural stability, low thermal conduction, high permeability resistance and material properties, which allow welding and machining.

Still referring to FIGS. 4 and 5*a*, the housing 201 includes several sections that are arranged and configured to support and/or house different sub-assemblies. It will be appreciated that the housing 201, in addition to its structural support and sealing functions, also provides other functions moving from a closed, first end 213 of the housing 201 to an open, second end 214 of the housing 201. The closed end 214 of the housing 201 may be kept open to simplify the final machining sequence for alignment, but it is required to finally close it by welding, brazing, epoxying or any hermetic thermal shock resistant procedure.

First section 215 is located at the end closest to first end 213. First section 215 is arranged and configured to act as a cold finger about its exterior. In the preferred embodiment, first section 215 extends through the vacuum flange 200 (e.g., see FIG. 3). The HTS filters (not shown) are subsequently attached to a mounting bracket 252 (best seen in FIG. 3) at, or proximate to, first end 213. First section 215 is also arranged and configured to house regenerator unit 122 (best seen in FIG. 3). First section 215 is preferably round and, in the preferred embodiment, has a smaller diameter than the other sections of the housing 201.

Second section 217 is located next to first section 215, with first transition section 216 located therebetween. Vacuum flange 200 is mounted on the exterior of second section 217. Preferably, the vacuum flange 200 is mounted via a shrink to fit process. Accordingly, the exterior of the second section 217 is preferably machined to an appropriate diameter (with a controlled tolerance) to accomplish this connection. As will be appreciated, the connection between the vacuum flange 200 and second section 217 provides a seal for the vacuum environment into which the cold finger (e.g., the first section 215) extends. The interior of second section 217 generally cooperates with and supports heat exchanger unit 114. The second section 217 is preferably round and, in the preferred embodiment has a larger diameter than first section 215.

Third section 219 is located next to second section 217, with second transition section 218 located therebetween. On the exterior of third section 219, the coil 170 and the external laminations 204 are supported. The interior of third section 219 generally cooperates with and supports the internal components of the linear motor 116. The third section 219 is preferably round and, in the preferred embodiment has a larger diameter than second section 217.

Fourth section 221 is located next to third section 219, with third transition section 220 located therebetween. Fourth section 221 is located at or near open, second end 214. Fourth section 221 supports the spring assembly for the displacer assembly. It also sealingly engages with an end cap 250 (best seen in FIG. 3) to seal the cold end assembly. The fourth section 221 is preferably generally frusto-conical in shape. In the preferred embodiment the smaller end of the fourth section 221 has a larger diameter than third section 219.

As noted above, each of the sections 215, 217, 219 and 221 are preferably drawn to form a unitary and seamless housing 201. However, it will be appreciated that the individual sections might optionally be drawn as two or more component pieces and then subsequently assembled. While this optional method of manufacturing may be employed, in order to minimize the number of seams and improve the manufacturing processes of the cold-end assembly 100, it is preferred to draw the entire housing 201 in a single process.

It will also be appreciated that the first end 213 has been characterized as being closed, while the second end 214 has been characterized as being open. Such characterizations, however, should not be construed in a limiting manner. In the preferred embodiment, the second end 214 is open to enable assembly. However, if the housing 201 is manufactured in two or more component pieces (e.g., providing for a seam at transition section 218 and/or 220), then the second end 214 may be constructed in a closed fashion. Still further, it will be appreciated that the transition sections 216, 218 and 220 may optionally be eliminated and/or take on a number of shapes and configurations. The main function of such sections is to provide a transition between functional sections of the housing 201.

Figure 2B:
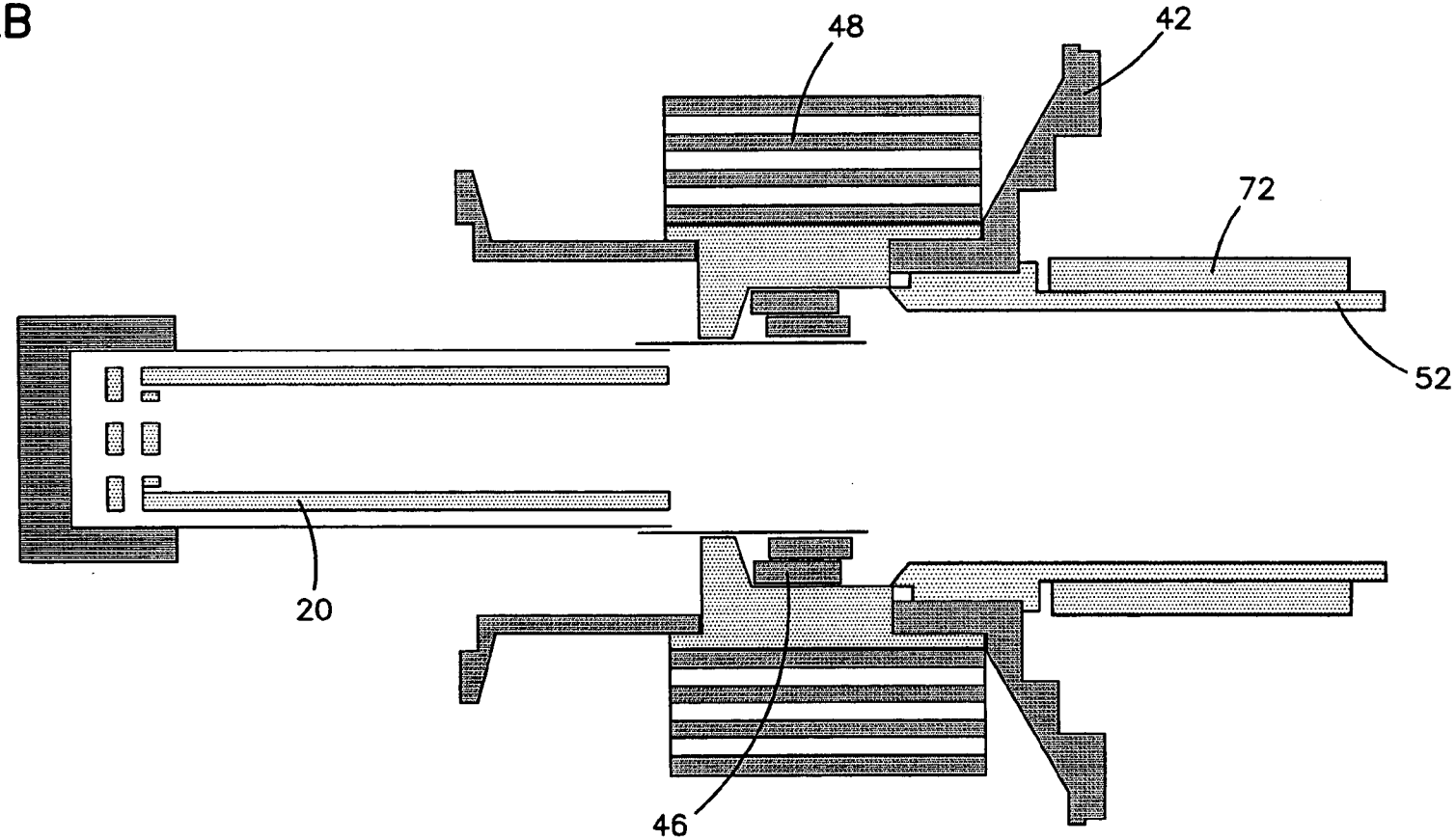
FIG.2B PRIOR ART
FIG. 2*b* is a cross sectional illustration of the various components of the cold end assembly of FIG. 1 that are replaced by components in an embodiment of the present invention constructed in accordance with the principles of the present invention.

FIGS. 5*a*–5*f* illustrate the various machining steps which preferably occur subsequent to the drawing process. At FIG. 5*a*, the internal surfaces of housing 201 have been manually honed and the inside diameters are machined at locations 301, 303, and 305. At FIG. 5*b*, the inner piston bore assembly 307, the heat exchanger block 309 and the spring stack mounting support 308 is inserted into the housing 201. At FIG. 5*c*, the exterior of housing 201 is machined at locations 311 (to reduce the thermal conduction path through the external housing material thickness), 313 (to produce a suitable dimension for a tight shrink fit connection), and 315 (to reduce the Eddy current loss path only for the external motor design—this machining step is not necessary for an internal motor design as described in connection with the alternative embodiment described below). These three locations 311, 313, and 315 generally correspond with first section 215, second section 217, and third section 219, respectively. At FIG. 5*d*, the vacuum flange 200 is preferably shrink fit onto housing 201 by heating the flange 200 and press fitting it into place. At FIG. 5*e*, the vacuum flange 200 surface designated by 317 is machined. This surface 317 will receive the external heat rejector 148 (best seen in FIG. 3). Finally at FIG. 5*f*, three more internal surfaces are machined. These three surfaces are designated at 319, 321 and 323. These last machining operations help maximize the alignment between the piston, compressor, and displacement assemblies. It will be appreciated that the components illustrated in FIG. 5*f* take the place of the prior art components shown in FIG. 2*b*.

By machining the components as described in connection with FIGS. 5*a*–5*f* above, the concentricity alignment of the components is improved. For example, in the prior art, the concentricity may have been approximately 0.0015". However, by constructing the housing 201 as described herein, the overall concentricity is improved to about 0.0007". This improvement in concentricity improves other tolerances, makes assembly easier, and provides for greater consistency in the manufacturing process.

Returning now to FIG. 3 a brief discussion will be presented describing an assembled cold-end assembly 100. The displacer unit 112 functions in a manner known to those of skill in the art and preferably includes a displacer housing 118, a displacer cylinder assembly 120 having a regenerator unit 122 mounted therein, and a displacer rod assembly 124. The displacer cylinder assembly 120 is slideably mounted within the displacer housing 118. A displacer end cap 127 is provided within a distal end of the displacer cylinder assembly 120. The displacer rod assembly 124 is coupled at a first end to a base section (not shown) of the displacer cylinder assembly 120 and coupled at the second end 134 to a displacer flexure spring assembly 132. Therefore, given the appropriate conditions, the displacer cylinder assembly 120 oscillates within the displacer housing 118. Due to the improved tolerances and in-line accuracy between the displacer cylinder assembly 120 and the piston bore, there is no need for the displacer liner as required in the prior art.

Still referring to FIG. 3, the heat exchanger unit 114 is located between the displacer unit 112 and the compressor and linear motor assembly 116. The heat exchanger unit includes a heat exchanger block 309 and a plurality of external heat rejector fins 148. Thus, the heat exchanger unit 114 is designed to facilitate heat dissipation from a gas, such as Helium, that is compressed in the region located at the juncture between the displacer unit 112 and the compressor and linear motor assembly 116 (i.e., the compression chamber, $P_{HOT}$). Preferably the heat exchanger block 309 is constructed of a high purity copper and is installed as a component within the housing 201 (described above). Preferably, the external heat rejector fins 148 are also made from high purity copper. Other materials exhibiting good thermal conduction characteristics might also be used. Due to the shrink to fit coupling of the vacuum flange 200 to the sealed chamber 201, there is no need for a heat exchanger mounting flange as in the prior art.

The compressor and linear motor assembly 116 are mounted within sealed chamber 201 and include a piston assembly 150. The piston assembly 150 includes a cylinder 152, a piston 154, a piston assembly mounting bracket 155 and a spring assembly 156. The piston assembly mounting bracket 155 provides a coupling between the piston 154 and the spring assembly 156. Piston 154 is adapted for reciprocating motion within the cylinder 152. One or more gas bearings 160 are provided within the exterior wall of the piston 154. The gas bearings 160 receive gas, e.g., Helium, from a sealed cavity 162. A check valve 163 provides a unidirectional fluid communication conduit between the sealed cavity 162 and the compression chamber of the cylinder (e.g., the area designated $P_{HOT}$) when the pressure of the gas within that region exceeds the pressure within the cavity 162 (i.e., exceeds the piston reservoir pressure).

The linear motor assembly 116 includes a plurality of external coils 170 and externally located outer laminations 204. The internal laminations 208 are mounted on the inner piston bore assembly 307. Moving magnets 210 are located beneath the coil 170, with the sealed chamber 201 located therebetween. Thus, it will be appreciated that, as the piston 154 moves within the cylinder 152, the moving internal magnets 210 also move.

Other types and styles of motors may optionally be utilized in the cold end assembly 100. For example, motor assembly 116 may be modified to include the motor designs of U.S. Pat. Nos. 4,602,174; 6,141,971; 6,427,450; and 6,483,207.

In Operation

During operation, the piston 154 and displacer cylinder assembly 120 generally oscillate at a resonant frequency of approximately 60 Hz and in such a manner that the oscillation of the displacer cylinder assembly 120 is approximately 90 degrees out of phase with the oscillation of the piston 154. It will be appreciated that this means that the motion of the displacer cylinder assembly 120 "leads" the motion of the piston 154 by approximately 90 degrees.

Those skilled in the art will appreciate that, when the displacer cylinder assembly 120 moves to the "cold" end of the displacer housing 118, most of the fluid, e.g. Helium, within the system is displaced to the warm end of the displacer housing 118 and/or moves around a flow diverter or similar structure and through the internal heat exchanger fins into the compression area of piston assembly 150. Due to the phase difference between the motion of the displacer cylinder assembly 120 and the piston 154, the piston 154 should be at mid-stroke and moving in a direction toward the flow diverter 140 when displacer cylinder assembly 120 is located at the cold end of the displacer housing 118. This causes the Helium in the area to be compressed, thus raising the temperature of the Helium. The heat of compression is transferred from the compressed Helium to the internal heat exchanger fins and from there to the heat exchanger block 309 and external heat rejector fins 148. From the heat rejector fins 148, the heat is transferred to ambient air. As the displacer assembly 120 moves to the warm end of the displacer housing 118, the Helium is displaced to the cold end of the displacer housing 118. As the Helium passes through the displacer cylinder 120, it deposits heat within the regenerator 122, and exits into the cold end of the displacer housing 118 at approximately 77 K. At this time, the compressor piston 154 preferably is at mid-stroke and moving in the direction of the piston flexure springs 156. This causes the Helium in the cold end of the displacer housing 118 to expand further reducing the temperature of the Helium and allowing the Helium to absorb heat. In this fashion, the cold end functions as a refrigeration unit and may act as a "cold" source.

Alternative Embodiment

Figure 6:
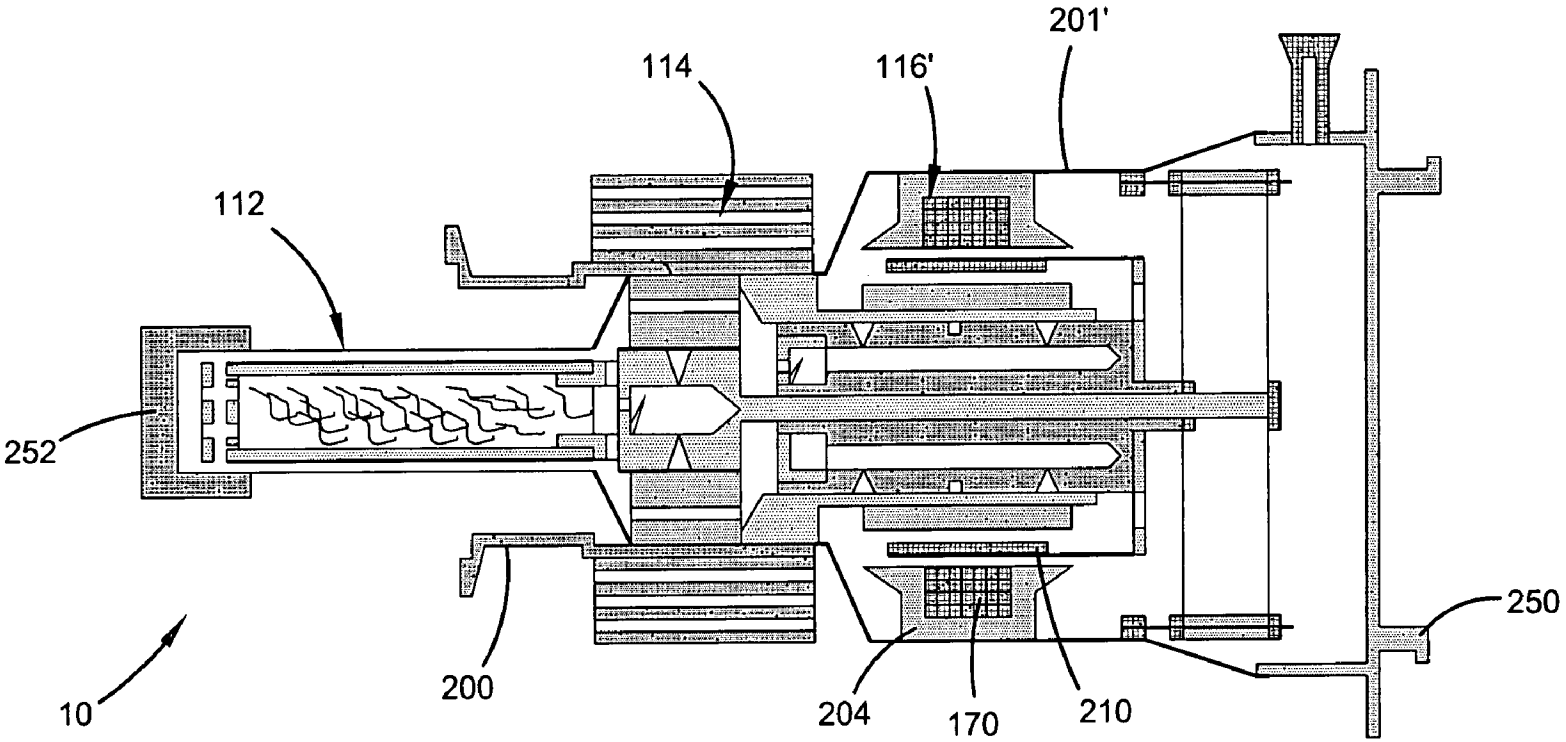
FIG. 6 is a cross-sectional illustration of an alternative embodiment cold end assembly constructed in accordance with the principles of the present invention, wherein the motor is located internal to the sealed external chamber.

FIG. 6 illustrates a cross section view of an alternative embodiment design constructed in accordance with the principles of the invention. The alternative embodiment includes an inner motor design or arrangement. More specifically, all of the components of the linear motor assembly 116' are located internally within the external sealed housing 201'. Other than the location of various components of the linear motor assembly 116' and the shape of the sealed housing 201', the other components and operation of the cryocooler 100' remain the same. It will be appreciated that the various components and the operation of the cryocooler 100' have been described in detail above in connection with cryocooler 100. Accordingly, such components will not be described in detail in connection with the alternative embodiment. However, a discussion of the external sealed housing 201' follows.

FIGS. 7*a*–7*f* illustrate the various machining steps which preferably occur subsequent to the drawing process of the housing 201'. At FIG. 7*a*, the internal surfaces of housing 201' have been manually honed and the inside diameters are machined at locations 301, 303', and 305'. It will be appreciated that due to locating parts of the linear motor assembly 116' within the housing 201', the diameter of the third section 219' is larger than third section 219 of housing 201 described above. Similarly, transition section 218' is changed so as to transition between second section 217 and third section 219'. Further, due to the larger circumference of section 219', transition section 220 may be eliminated. Instead, frustoconical shaped fourth section 221' may immediately be connected to third section 219'. It will further be appreciated that due to the increased diameter of third section 219' and the shape of fourth section 221', the corresponding machined locations in the alternative embodiment are designated 303' and 305', respectively. However, such locations are machined for similar purposes as locations 303 and 305 above.

Figure 7A:
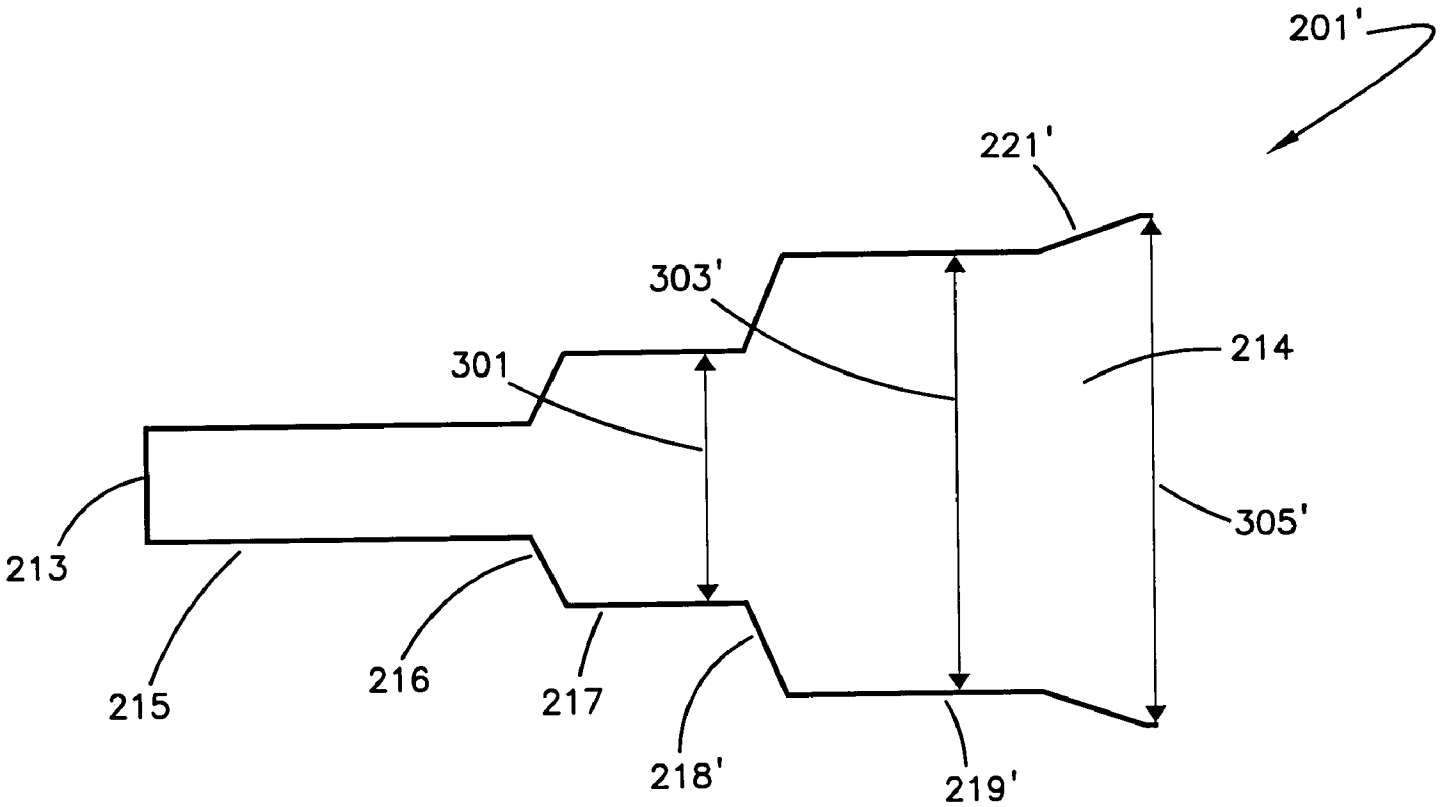
FIGS. 7*a*–7*f* are a series of cross-section illustrations for machining and assembling of the alternative embodiment cold end assembly of FIG. 6.
Figure 7B:
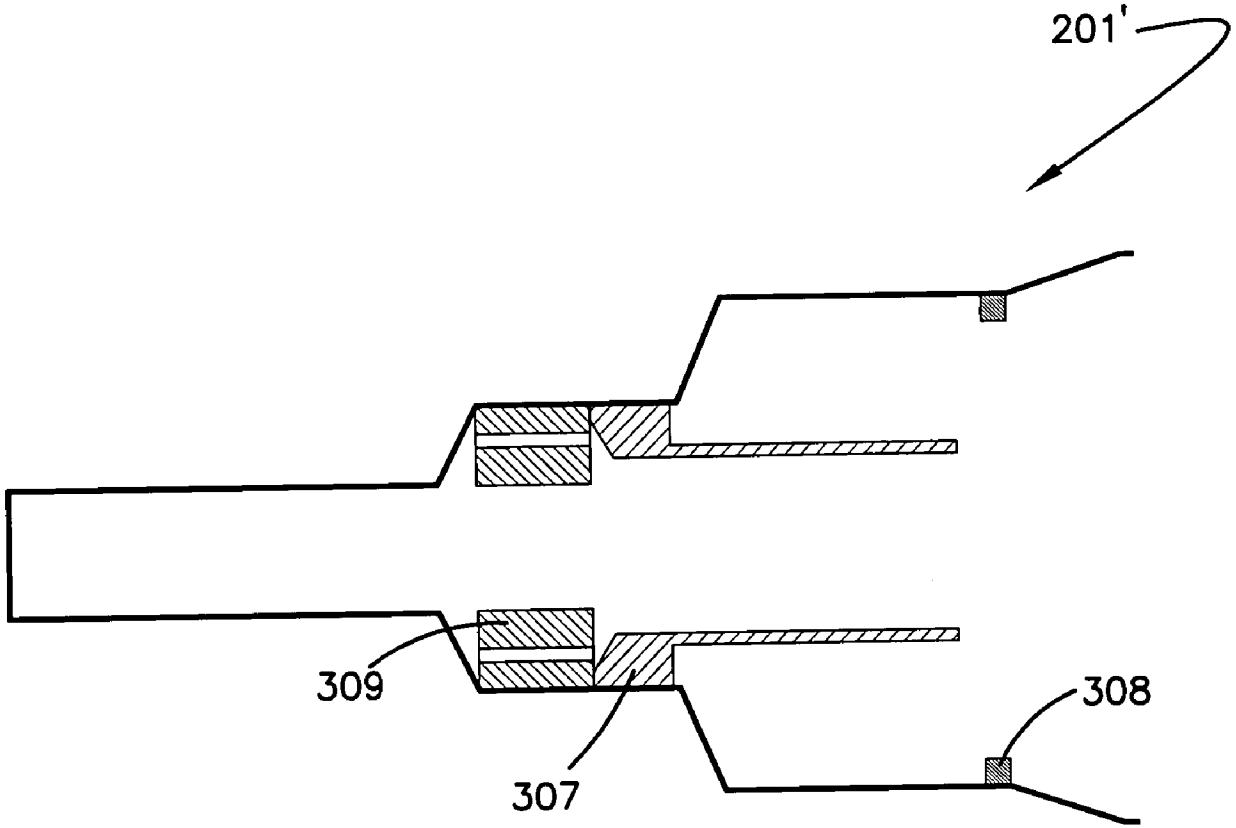
Figure 7C:
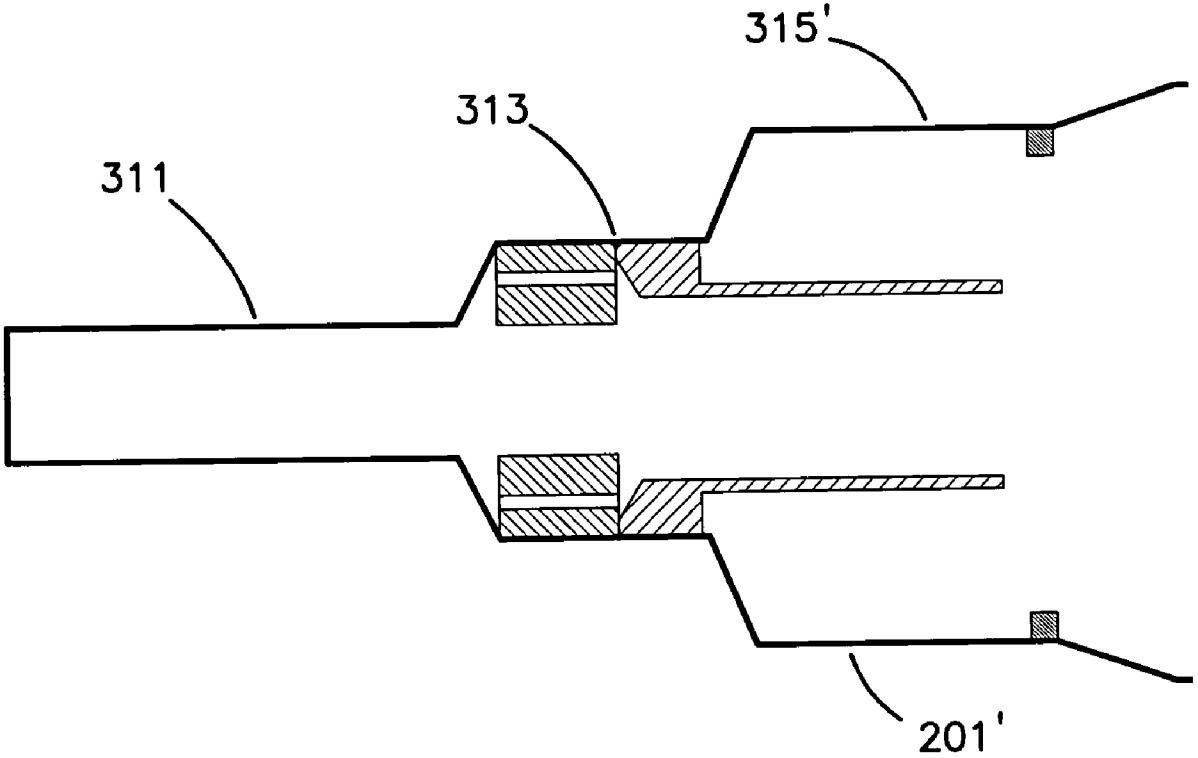
Figure 7D:
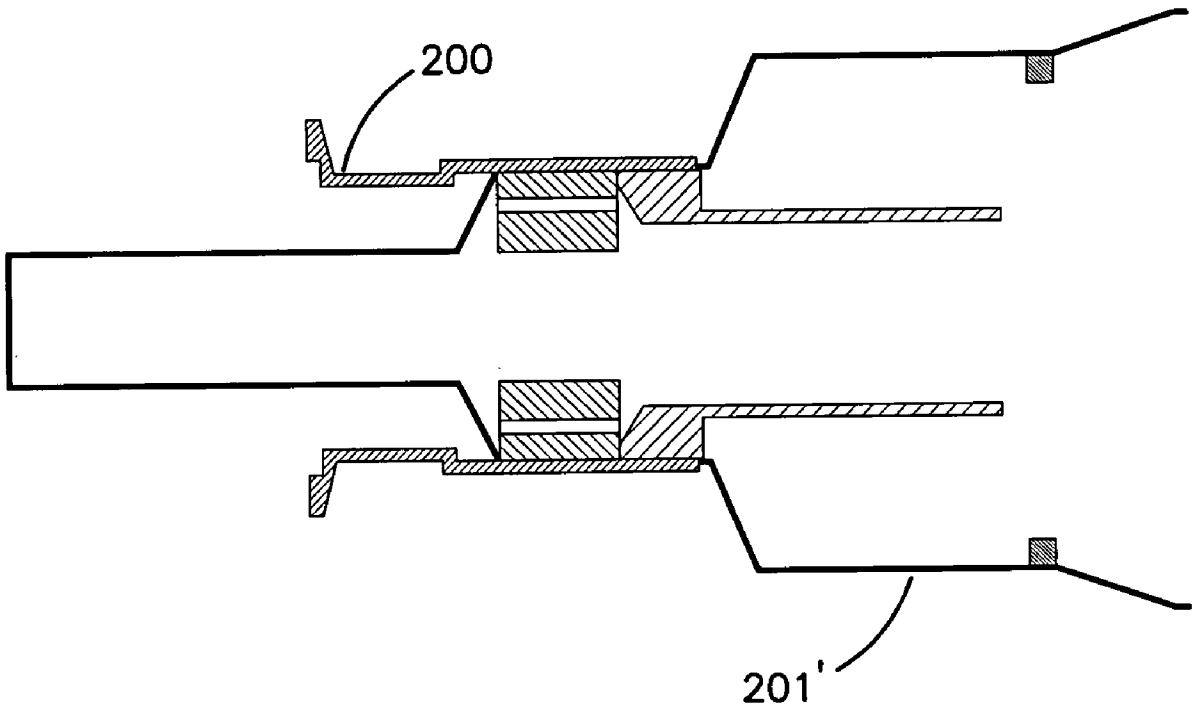
Figure 7E:
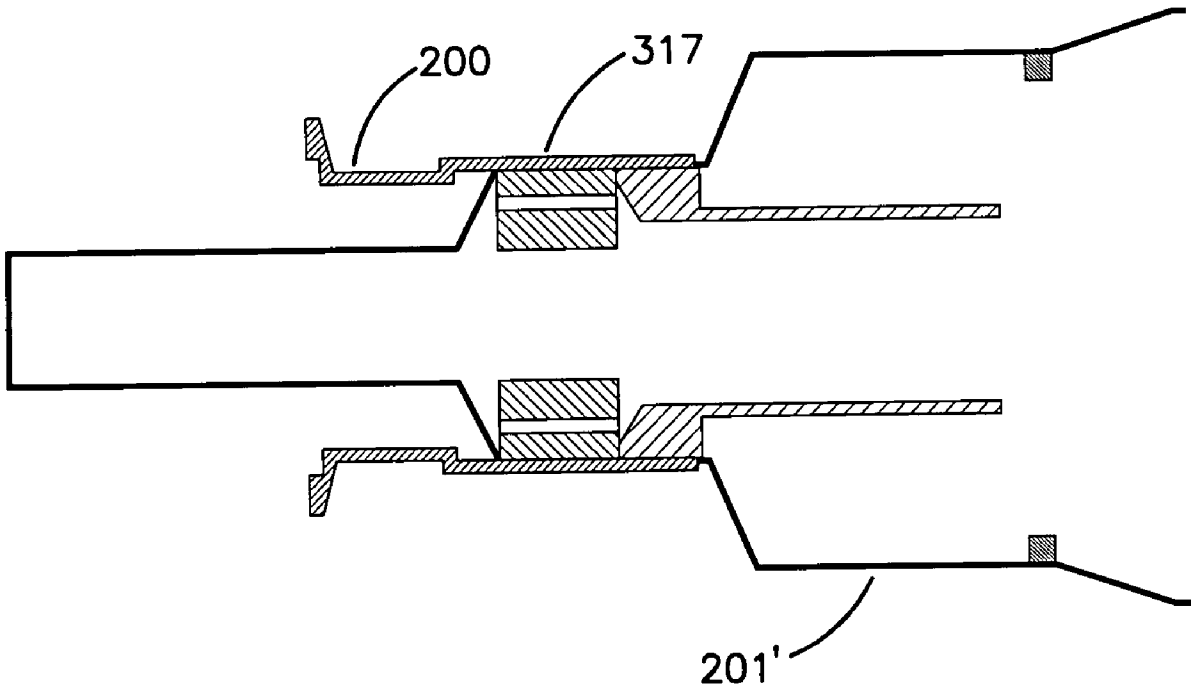
Figure 7F:
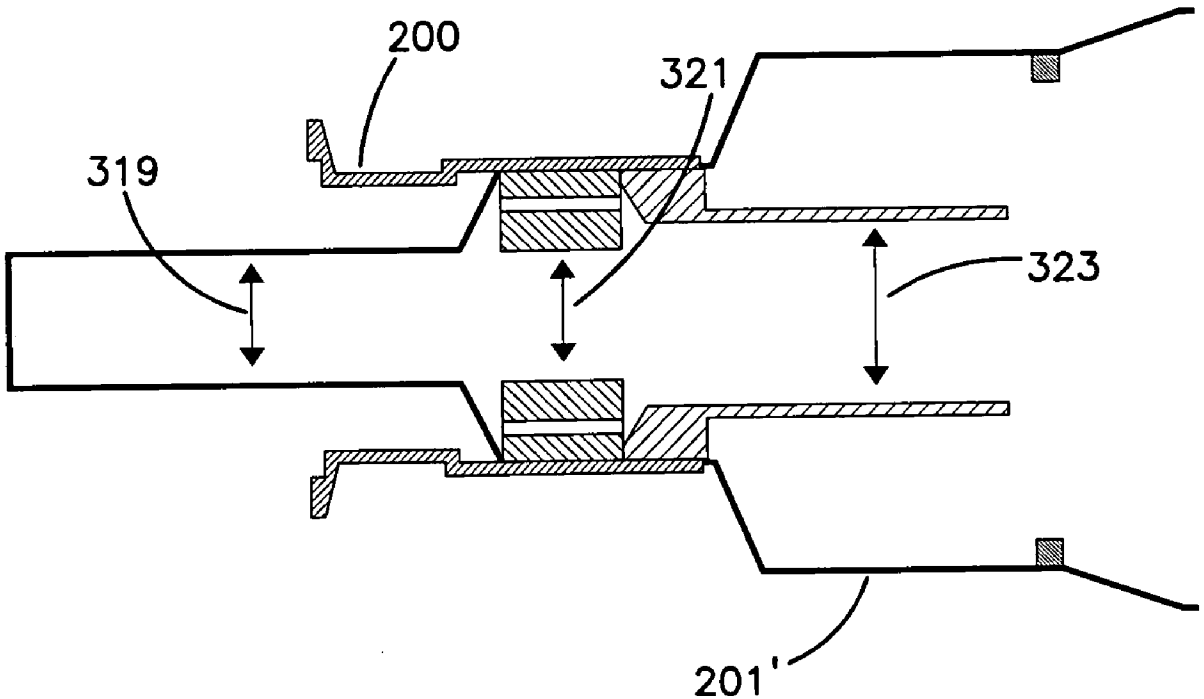

At FIG. 7*b*, the inner piston bore assembly 307 is inserted into the housing 201'. Also inserted into housing 201' is heat exchanger block 309 and the spring stack mounting support 308. At FIG. 7*c*, the exterior of housing 201' is machined at locations 311 (to reduce the thermal conduction path through the external housing material thickness), 313 (to produce a suitable dimension for a tight shrink fit connection) and, optionally, 315' (as noted above, this location does not have to be machined in the instance of an internal motor configuration). These locations generally correspond with first section 215, second section 217, and third section 219', respectively. At FIG. 7*d*, the vacuum flange 200 is preferably shrink fit onto housing 201' by heating the flange 200 and press fitting it into place. At FIG. 7*e*, the vacuum flange 200 surface designated by 317 is machined. This surface 317 will receive the external heat rejector fins 148. Finally at FIG. 7*f*, three more internal surfaces are machined. These three surfaces are designated at 319, 321 and 323. These last machining operations help maximize the alignment between the piston, compressor, and displacement assemblies. It will be appreciated that the components illustrated in FIG. 7*f* take the place of the prior art components shown in FIG. 2*b*.

While particular embodiments of the invention have been described with respect to its application, it will be understood by those skilled in the art that the invention is not limited by such application or embodiment or the particular components disclosed and described herein. It will be appreciated by those skilled in the art that other components that embody the principles of this invention and other applications therefor other than as described herein can be configured within the spirit and intent of this invention. The arrangement described herein is provided as only one example of an embodiment that incorporates and practices the principles of this invention. Other modifications and alterations are well within the knowledge of those skilled in the art and are to be included within the broad scope of the appended claims.

What is claimed is:

1. An external housing of a cryocooler, of the type including a heat exchanger, a displacer cylinder assembly and a displacer cylinder primary mover, the external housing comprising:

a substantially unitary one-piece housing arranged and configured to house the heat exchanger, the displacer cylinder assembly and at least a portion of the displacer cylinder primary mover.

2. The housing of claim 1, wherein the substanially unitary housing comprises a first section arranged and configured to act as a cold finger and to substantially house the displacer cylinder assembly; a second section arranged and configured to substantially house a heat exchanger; and a third section arranged and configured to substantially house at least a portion of the displacer cylinder primary mover.

3. The housing of claim 2, further comprising a fourth section arranged and configured to cooperatively attach to an end cap.

4. The housing of claim 2, wherein the second section is further arranged and configured to matingly engage a vacuum flange.

5. The housing of claim 4, wherein the combination of the second section and the vacuum flange is arranged and configured to provide structural support for a heat rejector located about the periphery of the vacuum flange.

6. The housing of claim 5, wherein the first section, the second section and the third section each have a generally round cross section.

7. The housing of claim 6, wherein the second section has a larger cross section than the first section and the third section has a larger cross section than the second section.

8. The housing of claim 2, wherein the first section is seamlessly connected to the second section with a first transition section.

9. The housing of claim 2, wherein the second section is seamlessly connected to the third section with a second transition section.

10. The housing of claim 3, wherein the third section is seamlessly connected to the fourth section with a third transition section.

11. The housing of claim 3, wherein:

a) the first section is seamlessly connected to the second section with a first transition section;

b) the second section is seamlessly connected to the third section with a second transition section; and c) the third section is seamlessly connected to the fourth section with a third transition section.

12. A housing for a cryocooler, of the type that includes a heat exchanger, a displacer cylinder assembly and a displacer cylinder primary mover, comprising:

a) a first section arranged and configured to act as a cold finger and to substantially house the displacer cylinder assembly;

b) a second section arranged and configured to substantially house a heat exchanger; and c) a third section arranged and configured to substantially house at least a portion of the displacer cylinder primary mover; and wherein at least two of the first section, second section and third sections have different diameters from each other and are seamlessly connected to one another.

13. The housing of claim 12, wherein the first section is seamlessly connected to the second section and the second section is seamlessly connected to the third section.

14. The housing of claim 13, further comprising:

a) a first transition section between the first section and the second section; and b) a second transition section between the second and third sections.

15. A cryocooler, of the type used to compress a fluid at a hot end and deliver a cooled fluid to a cold end, comprising:

a) a primary mover;

b) a displacer cylinder operatively connected to the primary mover for compressing:

c) a heat exchanger; and d) a substantially seamless housing arranged and configured to support and substantially enclose the displacer cylinder and the heat exchanger, and to support and enclose at least a portion of the primary mover.

16. The cold end assembly of claim 15, wherein the housing is entirely seamless from a first end to a second end, and wherein the housing is closed at the first end and open at the second end during an assembly stage.

17. The cold end assembly of claim 16, further comprising an end cap, the end cap sealing engaging the second end of the housing.

18. A Stirling cycle cryocooler, comprising:

a) a displacer unit;

b) a heat exchanger unit, c) a compressor and linear motor assembly; and d) a unitary one-piece sealed housing, wherein the housing is arranged and configured to support and enclose at least portions of the displacer unit, the heat exchanger, and the compressor and linear motor assembly.

19. The cryocooler of claim 18, wherein the housing is entirely seamless from a first end to a second end, and wherein the housing is closed at the first end and open at the second end during an assembly stage.

20. The cryocooler of claim 19, further comprising an end cap, the end cap sealing engaging the second end of the housing.

21. A method of fabricating a housing for a cryocooler, comprising:

a) drawing a unitary housing for the cryocooler;

b) machining at least one selected internal diameter of the housing;

c) installing a piston bore assembly proximate at least one of the machined internal diameters;

d) machining at least one selected external diameter of the housing; and e) installing a vacuum flange proximate at least one of the selected external diameters.

22. The external housing of claim 2, wherein at least two of the first, second and third section have different diameters from each other.

* * * * *